US007591744B2

(12) United States Patent
Morrow et al.

(10) Patent No.: US 7,591,744 B2
(45) **Date of Patent: *Sep. 22, 2009**

(54) LACROSSE HEAD

(75) Inventors: David Morrow, Farmington Hills, MI (US); Jesse Hubbard, New York, NY (US)

(73) Assignee: Warrior Sports, Inc., Warren, MI (US)

( * ) Notice: Subject to any disclaimer, the term of this patent is extended or adjusted under 35 U.S.C. 154(b) by 223 days.

This patent is subject to a terminal disclaimer.

(21) Appl. No.: 11/344,518

(22) Filed: Jan. 31, 2006

(65) Prior Publication Data

US 2008/0039243 A1 Feb. 14, 2008

Related U.S. Application Data

(60) Division of application No. 10/755,858, filed on Jan. 12, 2004, now Pat. No. 6,994,640, which is a continuation of application No. 10/187,769, filed on Jul. 2, 2002, now Pat. No. 6,676,547.

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/512, 505; D21/724
See application file for complete search history.

(56) References Cited

U.S. PATENT DOCUMENTS

| | | | | |
|---|---|---|---|---|
| 6,676,547 | B1 * | 1/2004 | Morrow et al. | 473/513 |
| 6,723,134 | B2 * | 4/2004 | Tucker, Sr. | 473/513 |
| 6,910,976 | B2 * | 6/2005 | Tucker, Sr. | 473/513 |
| 6,994,640 | B2 * | 2/2006 | Morrow et al. | 473/513 |
| 7,101,294 | B2 * | 9/2006 | Tucker, Sr. | 473/513 |
| 7,226,374 | B2 * | 6/2007 | Morrow et al. | 473/513 |

* cited by examiner

*Primary Examiner*—Gene Kim
*Assistant Examiner*—M Chambers
(74) *Attorney, Agent, or Firm*—Warner Norcross & Judd LLP

(57) ABSTRACT

A lacrosse head (10) is provided for improving ball retention and throwing accuracy. The lacrosse head (10) includes a pair of opposing sidewall portions (14) each having a top end, a bottom end, and an inner intermediate section with a shelf (28) integrated therein. Each shelf assists a user in retaining a lacrosse ball within the lacrosse head (10). The top ends of the opposing sidewall portions (14) are connected to each other by a scoop portion (16) that has a non-skid surface formed thereon for gripping the lacrosse ball. The bottom ends of the opposing sidewall portions (14) are connected by a base portion (18).

50 Claims, 4 Drawing Sheets

LACROSSE HEAD

CROSS-REFERENCE TO RELATED APPLICATIONS

This is a division of U.S. patent application Ser. No. 10/755,858 filed on Jan. 12, 2004 now U.S. Pat. No. 6,994,640, which is a continuation of U.S. patent application Ser. No. 10/187,769 filed on Jul. 2, 2002 now issued as U.S. Pat. No. 6,676,547.

TECHNICAL FIELD

The present invention relates generally to lacrosse heads, and more particularly to lacrosse heads having increased ball retention capabilities and improved shooting and passing accuracy.

BACKGROUND OF THE INVENTION

Lacrosse heads for use in the game of lacrosse are well-known and take on a variety of configurations. Current lacrosse heads are typically manufactured by injection molding processes and are secured to a metal lacrosse handle for use in play. The structure of current lacrosse heads is commonly defined by a base portion that is disposed adjacent to the connection of the handle, a pair of opposing sidewall portions that diverge from the base portion, and a scoop portion that connects the ends of the pair of opposing sidewall portions opposite the base portion. Lacrosse heads are also intended to receive a netting thereon that connects to the base portion, the pair of opposing sidewall portions, and the scoop portion. The netting is intended to retain a lacrosse ball therein.

The scoop portions on current lacrosse heads have a generally smooth and planar inner surface. The smooth planar inner surface is intended to facilitate scooping of ground balls. As is also known, lacrosse heads for use by women are not allowed to have a pocket formed in the netting. As such, when the ball is thrown or passed, it typically contacts the inner surface of the scoop as it is being caused to exit the head. The smooth planar inner surface of the scoop thus assists this action.

It is also understood that certain players, besides those mandated by rules, prefer to string their lacrosse heads with shallow pockets or no pockets. This is done by a variety of different players, including quick forwards or players who desire a quicker release of the lacrosse ball and those who desire the ability to pass over longer distances. The lacrosse ball typically also contacts the scoop portion of the lacrosse head as it exits the head. Therefore, the smooth planar inner surface similarly assists these players with these actions.

A drawback of these lacrosse heads having a scoop with a smooth inner surface is that the lacrosse ball may slide or skid laterally across the smooth surface of the scoop portion as it is being thrown. As a result, the user's line of throwing may be skewed thereby decreasing his accuracy while passing and shooting.

In addition, the smooth surface may cause the lacrosse ball to slide or skid across the scoop portion in a manner that allows the lacrosse ball to be flung through the air with relatively little or no spin. As is known in the art, a lacrosse ball travelling through the air with relatively little or no spin can take an erratic path thereby further decreasing the user's accuracy. It is also known that a lacrosse ball without spin travels slower through the air than one having spin.

Furthermore, existing scoop portions are sufficiently flat across their lateral width such that the lacrosse ball may be thrown from a corner of the lacrosse head where the scoop portion connects to either of the sidewall portions. Throwing the lacrosse ball in this manner does not allow for precise throws. Instead, this type of throwing may skew the user's line of throwing and decrease his accuracy. It is typically desirable to throw the ball in a manner such that the ball rolls off a center section of the scoop portion. Moreover, the lacrosse ball can inadvertently fall out of the head at one of the corners because of its flat configuration.

Existing sidewall portions of lacrosse heads are sufficiently flat such that the lacrosse ball may inadvertently roll off one of the sidewall portions out of the lacrosse head, such as when a player is being checked. Such an adverse effect typically occurs while cradling the ball in a lacrosse head having a shallow pocket. Some lacrosse heads have been manufactured with ball retention ribs or ridges However, these structures are located along the upper rim and thus can decrease the effective catching area of the lacrosse head.

Therefore, it would be advantageous to provide a lacrosse head that allows for accurate, high velocity throwing, in addition to improved ball retention.

SUMMARY OF THE INVENTION

The present invention provides a lacrosse head that provides improved ball retention capabilities as well as improved throwing accuracy. The lacrosse head includes a pair of opposing sidewall portions each having a top end, a bottom end, and an inner intermediate section. The inner intermediate section of each of the sidewalls has a shelf integrally formed therein for retaining a lacrosse ball within the frame of the head. The top ends of the opposing sidewall portions are connected to each other by a scoop portion. The scoop portion has a non-skid surface formed thereon, which creates friction for the lacrosse ball as it exits the head. The bottom ends of the opposing sidewall portions are connected by a base portion.

One advantage of the present invention is that the lacrosse head provides a user with improved throwing accuracy.

Another advantage of the present invention is that the lacrosse head allows a user to throw the lacrosse ball with greater velocity.

Yet another advantage of the present invention is that the lacrosse head allows a user to easily retain the ball within the head while a user is cradling the ball and/or running.

Still another advantage of the present invention is that the lacrosse head allows the user to scoop the ball into the head easier.

Other advantages of the present invention will become apparent when viewed in light of the detailed description of the preferred embodiment when taken in conjunction with the attached drawings and appended claims.

DETAILED DESCRIPTION OF THE PREFERRED EMBODIMENT

Figure 1:
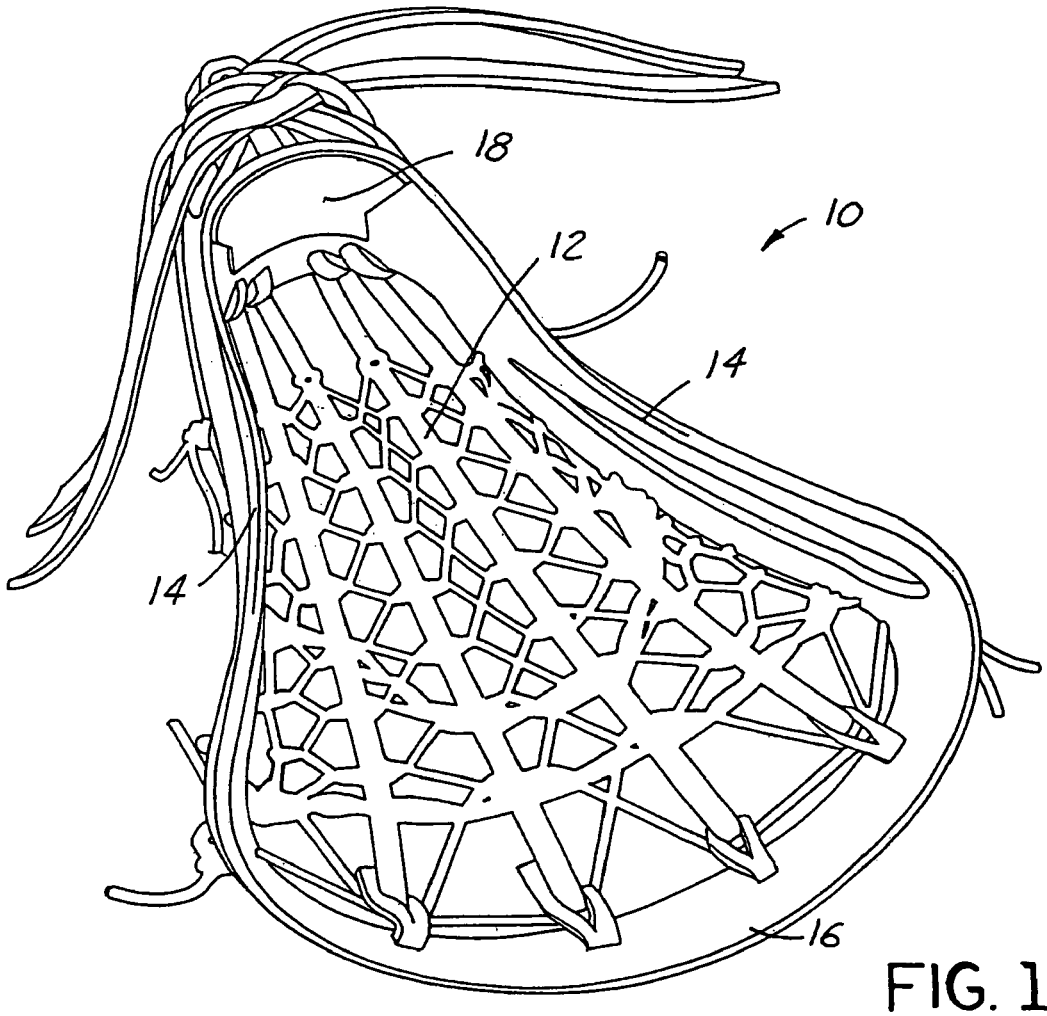
FIG. 1 is a perspective view of a lacrosse head having a shallow pocket according to a preferred embodiment of the present invention.
Figure 3:
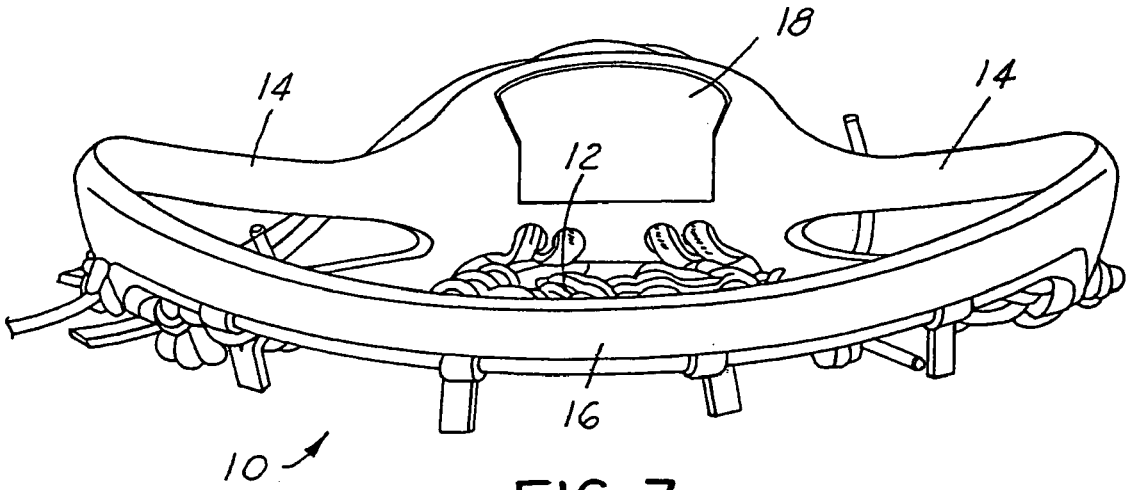
FIG. 3 is a top view of a lacrosse head having a shallow pocket according to a preferred embodiment of the present invention.
Figure 2:
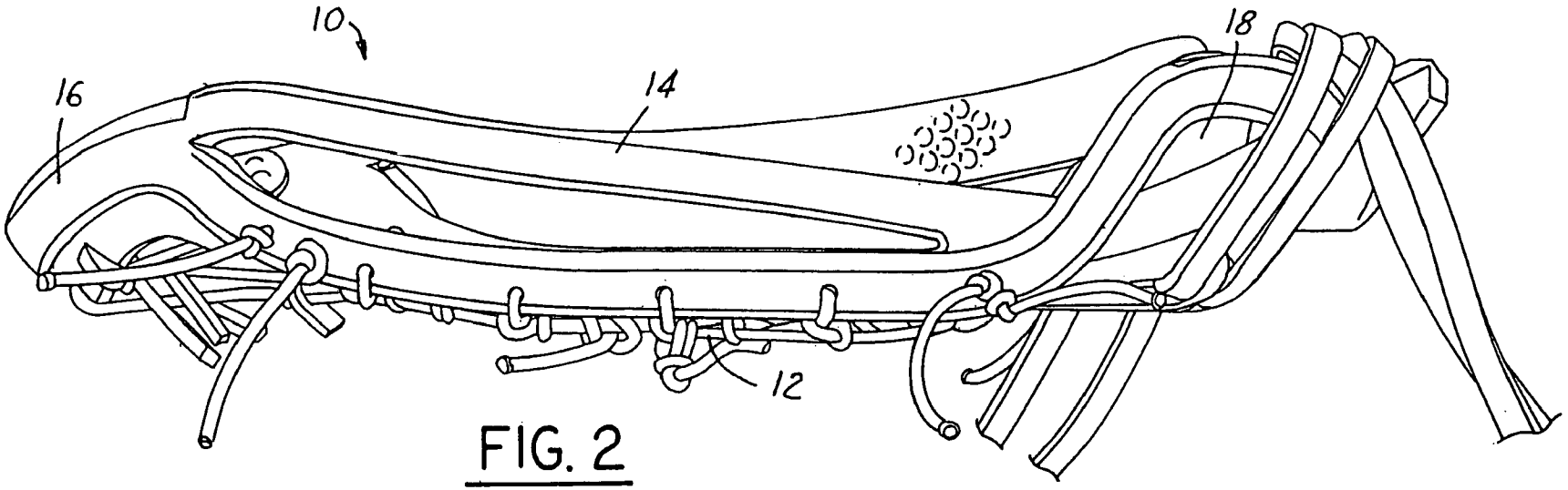
FIG. 2 is a side view of a lacrosse head having a shallow pocket according to a preferred embodiment of the present invention.
Figure 4:
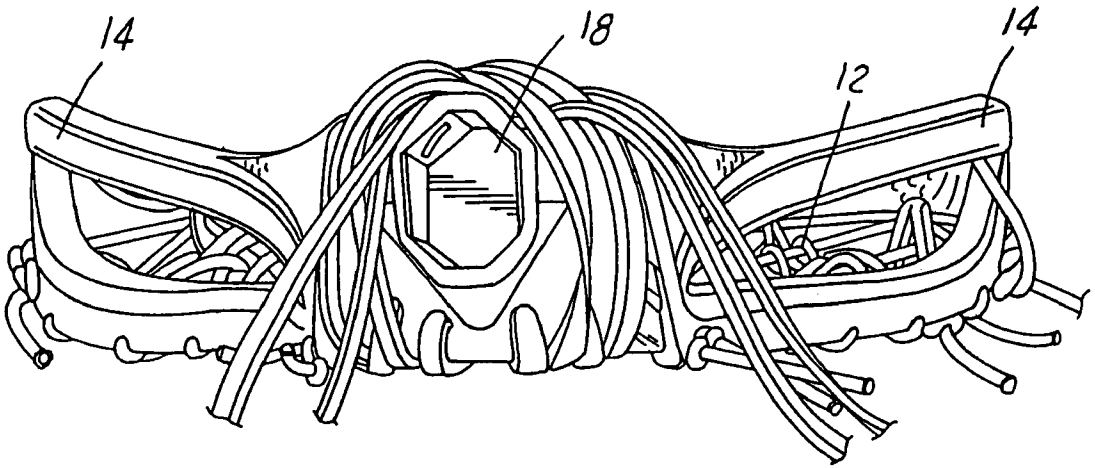
FIG. 4 is a bottom view of a lacrosse head having a shallow pocket according to a preferred embodiment of the present invention.

In the following figures, the same reference numerals are used to identify the same components in the various views.

Referring primarily to FIGS. 1 through 4, there are generally shown views of a lacrosse head 10 having a pocket 12 with shallow depth according to a preferred embodiment of the present invention. The lacrosse head 10 preferably is a single integral piece including a pair of opposing sidewall portions 14, a scoop portion 16 extending between the top ends of the sidewall portions 14, and a base portion 18 extending between the bottom ends of the sidewall portions 14, with the sidewall portions 14 diverging from the base portion 18. The pair of opposing sidewall portions 14, the scoop portion 16, and the base portion 18 together form a frame. The frame is preferably comprised of a plastic material and the frame is preferably formed by injection molding processes. Of course, it is understood that the lacrosse head 10 may be constructed in various other suitable ways from other materials, and from other manufacturing processes.

Typically, either a traditional pocket 12 (as shown in FIGS. 1 through 5) or a mesh pocket extends between and is supported by the sidewall portions 14, the scoop portion 16, and the base portion 18 for retaining a lacrosse ball within the head. Obviously, pockets made from other materials and attached in a variety of ways may be utilized. The pocket 12 preferably has a shallow depth for allowing quick release and long distance throws. Fast break lacrosse players typically adjust their pocket depth accordingly for enabling these results. Moreover, it is known in the art that women's lacrosse heads also typically have pockets with shallow depth, as is regulated by rule. However, it is understood that players may desire or require lacrosse heads having pockets of shallow depth for a variety of different reasons.

As is known in the art, a pocket 12 having shallow depth typically causes the lacrosse ball to be thrown off or contact the scoop portion 16 as it is exiting the lacrosse head 10. Of course, a variety of other pocket depths may cause the lacrosse ball to be thrown off the scoop portion 16. Thus, while the invention disclosed herein is preferably for use with a lacrosse head having a shallow pocket, such as a lacrosse head for use in women's play, it can be utilized with any other lacrosse head.

Figure 6:
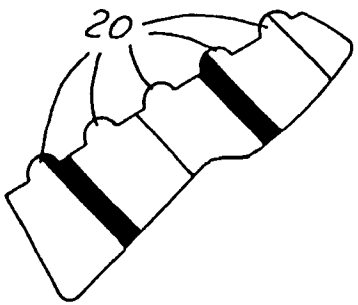
FIG. 6 is a cross-sectional view of a scoop portion of the lacrosse head shown in FIG. 5, as taken along line 6-6.
Figure 5:
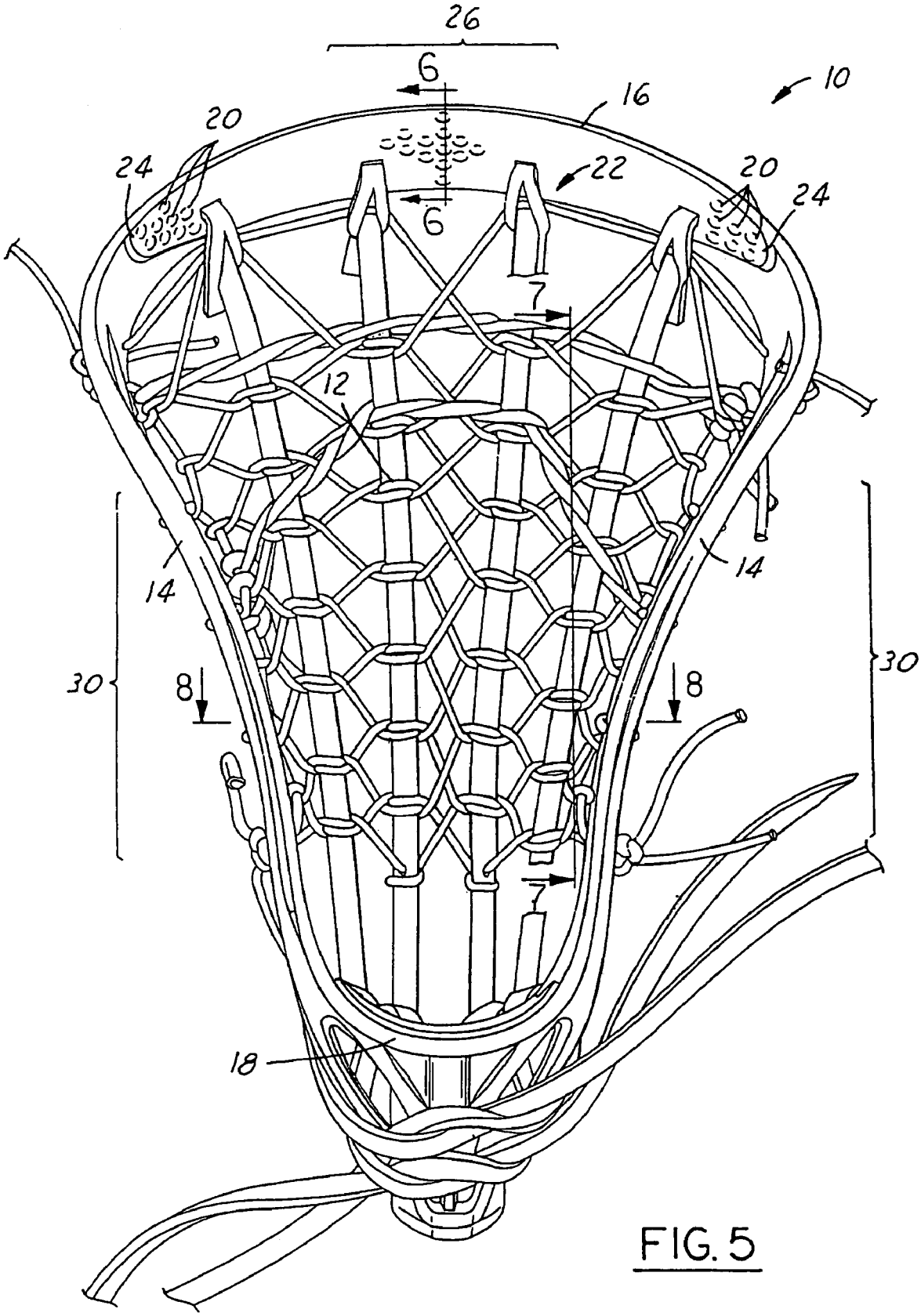
FIG. 5 is a front view of a lacrosse head having a shallow pocket according to a preferred embodiment of the present invention.

Referring now to FIGS. 5 and 6, there are shown, respectively, a front view and a cross-sectional view of the lacrosse head 10 that best illustrate the scoop portion 16 according to a preferred embodiment of the present invention. The scoop portion 16 preferably includes a non-skid surface formed thereon for gripping a lacrosse ball that comes in contact with it. Preferably the non-skid surface is a plurality of nubs 20 formed on the scoop portion 16. However, it is understood that various types of textured surfaces and materials may be employed for providing friction between the lacrosse ball and the scoop portion 16. For example, the non-skid surface can be created by application of a separate coating or the no-skid surface may result from the material for which the head is manufactured. It will also be understood that the non-skid surface can be located anywhere on the head, including the ball stop area or the sidewalls. Moreover, the non-skid surface may be applied by an overmolding process.

The nubs 20 preferably are integral parts of the scoop portion 16 of the lacrosse head 10, but may be otherwise as desired. For example, a strip of plastic having nubs formed thereon may be attached or otherwise adhered to existing scoop portions of lacrosse heads. The nubs 20 are preferably hemispherical protrusions extending from the surface of the scoop portion 16. Of course, it is understood that the nubs 20 may comprise other suitable shapes other than hemispherical, such as rectangular, square, oval, or conical. Moreover, while nubs 20 are the preferred surface deformity, other surface deformities or irregularities may be utilized, including dimples. Further, the non-skid structures can be created by post manufacturing processes, such as by overmolding.

These nubs 20 or other surface unevenness are interspersed across the scoop portion 16 to allow for increased gripping on a lacrosse ball thrown off the scoop portion 16. In other words, the nubs 20 impart friction to the lacrosse ball, which can prevent it from slipping as well as imparting spin thereto. The density of nubs 20 per square inch is sufficient to provide the maximum amount of grip on the lacrosse ball. For example, there are preferably thirty (30) nubs 20 disposed within a square inch of the scoop portion 16. However, a variety of other patterns may be utilized. Moreover, the number of structures in a given area may also vary as desired. The nubs 20 are preferably dispersed over a substantial or large portion of the scoop 16. However, it will be understood that the nubs 20 may be selectively positioned along certain advantageous portions of the scoop 16, such as the center section, which primarily contacts the lacrosse ball.

As the user throws a lacrosse ball off the scoop portion 16, the nubs 20 grip the lacrosse ball and prevent it from sliding off the scoop portion 16 as well as prevent it from sliding laterally or side-to-side. Instead, the nubs 20 cause the lacrosse ball to roll off the scoop portion 16 with a substantial amount of spin. A person skilled in the art will understand that applying spin to the lacrosse ball produces aerodynamic conditions which enable the lacrosse ball to travel through the air with greater velocity than it would without spin. The nubs 20 also will assist a player in scooping up a lacrosse ball as opposed to pushing it across the ground because the non-skid surface provides a better grip for the lacrosse ball. This is because of the friction applied to the ball causing it to rotate into the head instead of skidding.

In addition, the user's accuracy is improved when spin is applied to the lacrosse ball. It is known in the art that lacrosse balls thrown without spin can take erratic paths, which can cause them to miss their intended target. On the other hand, lacrosse balls thrown with spin follow predictable paths and consequently allow for greater throwing accuracy by the user.

The scoop portion 16 also preferably includes a ledge portion 22 including a pair of slanted surfaces 24. Preferably, the slanted surfaces 24 are formed by increasing the thickness of the scoop portion 16. The slanted surfaces 24 are intended to contact the lacrosse ball and direct it back into the pocket preventing a ball from inadvertently exiting the head in the corner areas of the scoop. The lacrosse ball 10 can then be thrown off a center section 26 of the scoop portion 16 thereby allowing for an improved direct line of throwing and consequently greater throwing accuracy. It is known in the art that the user's throwing accuracy is improved when the lacrosse ball is thrown from the center section of the scoop portion 16.

Preferably, two opposing slanted surfaces 24 are integrated within opposite ends of the scoop portion 16 adjacent to the sidewall portions 14. However, it is understood that more or less slanted surfaces 24 may be integrated within the same or different areas of the scoop portion 16 as desired.

Figure 7:
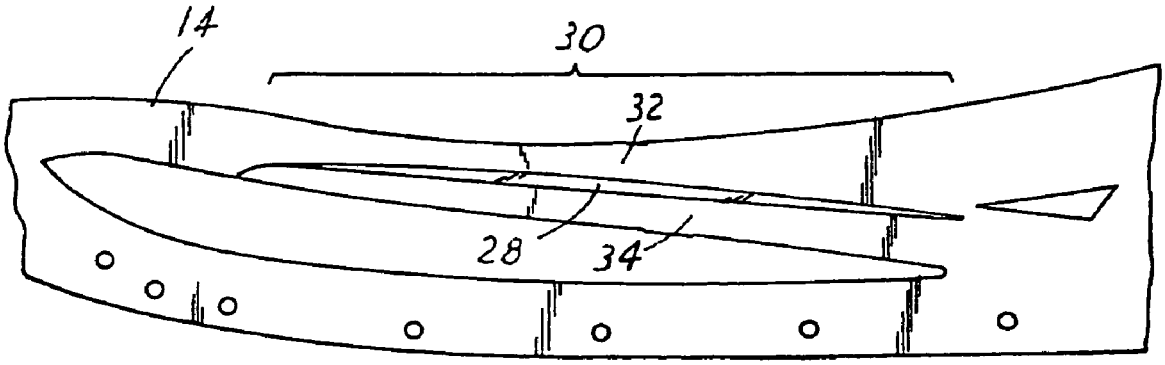
FIG. 7 is a cross-sectional view of a sidewall portion of the lacrosse head shown in FIG. 5, as taken along line 7-7.
Figure 8:
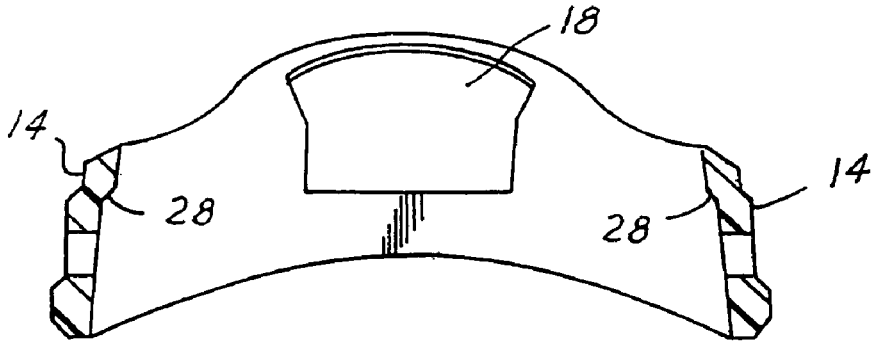
FIG. 8 is a cross-sectional view of the lacrosse head shown in FIG. 5, as taken along line 8-8.

Referring now to FIGS. 7 and 8, there are shown, respectively, a side view and a cross-sectional view of one of sidewall portions 14, each having a shelf 28 formed therein according to a preferred embodiment of the present invention. The shelf 28 is intended to contact the lacrosse ball and thereby assist the user in retaining the lacrosse ball within the lacrosse head 10 as the user cradles the lacrosse ball or as the lacrosse head is being checked. As is known in the art, it is particularly difficult to retain a lacrosse ball within conventional lacrosse heads that are strung with a pocket of shallow depth. In this regard, the shelves 28 that are integrally formed in each sidewall portion 14 are intended to improve the user's ability to retain the lacrosse ball within the lacrosse head 10. Of course, it is understood that the shelves 28 improve ball retention for pockets that have various degrees of depth.

Preferably, each shelf 28 is formed within an inner intermediate section 30 of each sidewall portion 14. The inner intermediate section 30 preferably is the part of the sidewall portions 14 that is most frequently in contact with the lacrosse ball as the user cradles the lacrosse ball. However, it is understood that shelves 28 may be formed within other sections of the sidewall portions 14. The shelf 28 is preferably configured such that an upper portion 32 of the sidewall portion 14 extends further inwardly than a lower portion 34 of the sidewall portion 14 in the intermediate section 30. Obviously, the shelf 28 can take on a variety of different configurations.

While particular embodiments of the invention have been shown and described, numerous variations and alternate embodiments will occur to those skilled in the art. Accordingly, it is intended that the invention be limited only in terms of the appended claims.

What is claimed is:

1. A lacrosse head comprising:

a frame element, including a base portion, a scoop portion opposite said base portion, a socket portion for receiving a lacrosse stick, and a pair of opposing sidewalls extending between said base portion and said scoop portion;

said frame element having a smooth surface from which a plurality of spaced-apart nubs project to form an integral non-skid surface for eliminating spin between said non-skid surface and a lacrosse ball wherein said nubs are formed as protrusions projecting from the smooth surface of the frame, said protrusions being visibly spaced apart from one another.

2. The lacrosse head of claim 1, wherein said non-skid surface is located on said scoop portion.

3. The lacrosse head of claim 1, wherein said non-skid surface is located on said base portion.

4. The lacrosse head of claim 1, wherein said non-skid surface is located on at least one of said opposing sidewalls.

5. The lacrosse head of claim 4, wherein each of said opposing sidewalls includes a non-skid surface.

6. The lacrosse head of claim 1, wherein said non-skid surface is formed on said base and each of said pair of opposing sidewalls.

7. The lacrosse head of claim 1, wherein said non-skid surface is selectively positioned on said scoop portion to grip the lacrosse ball as a player shoots the lacrosse ball from the head, said non-skid surface preventing the lacrosse ball from sliding laterally across the scoop portion.

8. The lacrosse head of claim 1, wherein said non-skid surface includes a plurality of surface structures formed therein for decreasing spin between said plurality of structures and said lacrosse ball.

9. A lacrosse head comprising:

a frame element, including a base portion, a scoop portion opposite said base portion; a socket portion for receiving a lacrosse stick, and a pair of opposing sidewalls extending between said base portion and said scoop portion;

a non-skid surface having a plurality of raised structures disposed on at least one portion of said frame element for eliminating spin between said non-skid surface and a lacrosse ball, wherein said raised structures are selectively positioned and spaced from one another on said frame element to grip the lacrosse ball as a player shoots the lacrosse ball from the head, said raised structures preventing the lacrosse ball from sliding laterally across the scoop, said plurality of raised structures that each include a periphery surrounded by a smooth surface wherein said raised structures are formed as protrusions projecting from the smooth surface of the frame, said protrusions being visibly spaced apart from one another.

10. The lacrosse head of claim 9, wherein said non-skid surface is integrally formed on said frame element.

11. The lacrosse head of claim 9, wherein said non-skid surface is located on said scoop portion.

12. The lacrosse head of claim 9, wherein each of said opposing sidewalls includes a non-skid surface.

13. The lacrosse head of claim 9, wherein said non-skid surface includes a separate coating that is applied to said frame element.

14. The lacrosse head of claim 9, wherein said non-skid surface is applied to said frame element through an overmolding process.

15. A lacrosse head comprising:

a pair of opposing sidewall portions each having a top end and a bottom end;

a base portion extending between and connecting said bottom ends of said pair of opposing sidewall portions; and a scoop portion extending between and connecting said top ends of said pair of opposing sidewall portions, said scoop portion including a smooth surface from which a plurality of spaced-apart, visibly distinct nubs project to form a non-skid surface thereon to create friction between said surface and a lacrosse ball.

16. The lacrosse head of claim 15, wherein said non-skid surface is located in a center area of said scoop.

17. The lacrosse head of claim 15, wherein said non-skid surface is located along a substantial portion of said scoop.

18. The lacrosse head of claim 15, wherein said plurality of nubs is selectively positioned on said scoop portion to grip the lacrosse ball as a player shoots the lacrosse ball from the head, said nubs preventing the lacrosse ball from sliding laterally across the scoop.

19. The lacrosse head of claim 15, comprising a ledge portion formed on said scoop, said non-skid surface being located on said ledge portion, said scoop including corners located on opposite sides of said scoop.

20. The lacrosse head of claim 19, wherein said scoop portion includes at least one slanted surface extending downwardly from said ledge portion for directing said lacrosse ball toward said base portion generally away from said corners.

21. The lacrosse head of claim 15, wherein each of said nubs define a periphery, said periphery being substantially surrounded by said smooth surface.

22. The lacrosse head of claim 15, wherein each of said pair of opposing sidewall portions has a shelf integrated therein for retaining said lacrosse ball within the lacrosse head.

23. The lacrosse head of claim 22, wherein each of said pair of opposing sidewall portions has an inner intermediate section with said shelf disposed in said inner intermediate section.

24. The lacrosse head of claim 15, wherein each of said plurality of nubs comprises a hemispherical protrusion extending from said scoop portion.

25. A lacrosse head comprising:

a pair of opposing sidewall portions each having a top end, a bottom end, and an inner intermediate section;

a base portion extending between and connecting said bottom ends of said pair of opposing sidewall portions; and a scoop portion extending between and connecting said top ends of said pair of opposing sidewall portions, said scoop portion having a generally smooth surface with a plurality of visibly distinct nubs extending upwardly therefrom to form a non-planar surface, said non-planar surface adapted to create friction between a lacrosse ball and said scoop portion.

26. The lacrosse head of claim 25, wherein said scoop portion includes a ledge portion formed thereon for directing said lacrosse ball toward said base portion.

27. The lacrosse head of claim 26, wherein said scoop portion includes at least one slanted surface extending downwardly from said ledge portion for directing said lacrosse ball toward said base portion, wherein said at least one slanted surface is integrated within the scoop portion adjacent to one of said pair of opposing sidewall portions.

28. The lacrosse head of claim 25, wherein said plurality of nubs is selectively positioned on said scoop portion to grip the lacrosse ball as a player shoots the lacrosse ball from the head, said nubs preventing the lacrosse ball from sliding laterally across the scoop.

29. The lacrosse head of claim 28, wherein each of said nubs comprises a hemispherical protrusion extending from said scoop portion.

30. The lacrosse head of claim 25, wherein said inner intermediate section of each of said sidewalls has a shelf formed therein.

31. The lacrosse head of claim 30, wherein each of said shelves is disposed away from an upper rim of each of said sidewalls.

32. The lacrosse head of claim 25, further comprising a netting attached to the head for retaining said lacrosse ball within the lacrosse head, said netting forming a pocket.

33. A lacrosse head and netting combination comprising:

a pair of opposing sidewall portions each having a top end and a bottom end; a base portion extending between and connecting said bottom ends of said pair of opposing sidewall portions;

a scoop portion extending between and connecting said top ends of said pair of opposing sidewall portions, said scoop portion including a smooth surface from which a plurality of spaced-apart protrusions project to form a non-skid surface thereon to create friction between said surface and a lacrosse ball, said protrusions being visibly distinct to the human eye from one another; and wherein the netting is attached to the lacrosse head for retaining said lacrosse ball within the lacrosse head 34. The lacrosse head of claim 33, wherein said plurality of nubs is integrally formed on said scoop portion.

35. A lacrosse head comprising:

a frame element, including a base portion, a scoop portion opposite said base portion;

a socket portion for receiving a lacrosse stick; and a pair of opposing sidewall portions extending between said base portion and said scoop portion;

wherein said scoop and at least one of said base portion and said pair of opposing sidewalls include a smooth surface having a plurality of raised surface protrusions extending outwardly from said smooth surface, said surface protrusions being spaced from one another with said smooth surface being located therebetween, said plurality of surface protrusions forming at least one non-skid surface for eliminating spin between said non-skid surface and a lacrosse ball.

36. The lacrosse head of claim 35, wherein said at least one non-skid surface is located on a central portion of said scoop portion.

37. The lacrosse head of claim 35, wherein said at least one non-skid surface is located on said base portion.

38. The lacrosse head of claim 35, wherein said at least one non-skid surface is located on at least one of said opposing sidewall portions.

39. The lacrosse head of claim 35, wherein each of said opposing sidewall portions includes a non-skid surface.

40. The lacrosse head of claim 35, wherein said base and each of said opposing sidewalls includes a non-skid surface.

41. The lacrosse head of claim 35, wherein said surface structures are formed as a separate coating that is applied to said frame element.

42. The lacrosse head of claim 35, wherein said surface structures are applied to said frame element through an overmolding process.

43. The lacrosse head of claim 35, wherein said plurality of surface structures are formed through an overmolding process.

44. The lacrosse head of claim 35, wherein said plurality of surface structures create surface unevenness that causes said non-skid surface to be non-planar.

45. The lacrosse head of claim 35, wherein said plurality of surface structures are formed as of a plurality of nubs.

46. A lacrosse head comprising:

a pair of opposing sidewall portions each having a top end and a bottom end;

a base portion extending between and connecting said bottom ends of said pair of opposing sidewall portions; and a scoop portion extending between and connecting said top ends of said pair of opposing sidewall portions;

wherein at least one of said pair of opposing sidewall portions, said base portion and said scoop portion has a plurality of integral surface structures projecting from a smooth surface, said surface structures being visibly distinct from one another to the human eye, and forming a non-planar, non-skid surface to create friction between said non-skid surface and a lacrosse ball and thereby decrease spin resulting in improved player control.

47. The lacrosse head of claim 46, wherein said non non-skid surface is selectively positioned on said scoop portion to grip the lacrosse ball as a player shoots the lacrosse ball from the head, said non-skid surface preventing the lacrosse ball from sliding laterally across the scoop portion.

48. The lacrosse head of claim 46, wherein said surface structures form a unitary structure with the at least one opposing sidewall portions, base portion and scoop portion.

49. The lacrosse head of claim 46, wherein said surface structures are formed as a plurality of spaced-apart nubs.

50. The lacrosse head of claim 49, wherein each of said nubs is formed as a hemispherical protrusion.

* * * * *

UNITED STATES PATENT AND TRADEMARK OFFICE

CERTIFICATE OF CORRECTION

PATENT NO. : 7,591,744 B2
APPLICATION NO. : 11/344518
DATED : September 22, 2009
INVENTOR(S) : Morrow et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 423 days.

Signed and Sealed this

Twenty-first Day of September, 2010

David J. Kappos

David J. Kappos
*Director of the United States Patent and Trademark Office*